US008490746B2

(12) United States Patent
Cummings

(10) Patent No.: US 8,490,746 B2
(45) Date of Patent: Jul. 23, 2013

(54) AERIAL LIFT WITH SAFETY DEVICE

(75) Inventor: Paul Cummings, Bicester (GB)

(73) Assignee: Bluesky Solutions Limited (GB)

( * ) Notice: Subject to any disclaimer, the term of this patent is extended or adjusted under 35 U.S.C. 154(b) by 250 days.

(21) Appl. No.: 12/380,355

(22) Filed: Feb. 26, 2009

(65) Prior Publication Data

US 2009/0260920 A1 Oct. 22, 2009

(30) Foreign Application Priority Data

Feb. 28, 2008 (GB) ..... 0803611.3

(51) Int. Cl.
*E04G 1/00* (2006.01)

(52) U.S. Cl.
USPC ..... 182/2.2; 182/2.1; 182/18

(58) Field of Classification Search
USPC ..... 182/18, 148, 2.1–2.3, 2.7–2.11
See application file for complete search history.

(56) References Cited

U.S. PATENT DOCUMENTS

| | | | | |
|---|---|---|---|---|
| 2,666,417 | A * | 1/1954 | Harsch | 92/86 |
| 3,696,372 | A * | 10/1972 | Garrett et al. | 182/18 |
| 4,160,492 | A * | 7/1979 | Johnston | 182/2.2 |
| 4,456,093 | A * | 6/1984 | Finley et al. | 182/2.2 |
| 5,044,472 | A * | 9/1991 | Dammeyer et al. | 187/223 |
| 5,196,998 | A * | 3/1993 | Fulton | 700/65 |
| 5,390,104 | A * | 2/1995 | Fulton | 700/65 |
| 5,489,032 | A * | 2/1996 | Mayhall et al. | 212/285 |
| 5,934,409 | A * | 8/1999 | Citron et al. | 182/18 |
| 5,992,572 | A * | 11/1999 | Gilliland et al. | 187/231 |
| 6,170,606 | B1 * | 1/2001 | Merz | 182/2.1 |
| 6,170,607 | B1 * | 1/2001 | Freeman et al. | 182/18 |
| 6,174,124 | B1 * | 1/2001 | Haverfield et al. | 414/642 |
| 6,330,931 | B1 * | 12/2001 | Baillargeon et al. | 182/18 |
| 6,405,114 | B1 * | 6/2002 | Priestley et al. | 701/50 |
| 6,439,341 | B1 * | 8/2002 | Engvall et al. | 182/18 |
| 6,543,578 | B1 * | 4/2003 | Merz | 182/2.11 |
| 6,564,906 | B1 * | 5/2003 | Haack et al. | 187/222 |
| 6,585,079 | B1 * | 7/2003 | Weyer | 182/2.7 |

(Continued)

FOREIGN PATENT DOCUMENTS

| | | | |
|---|---|---|---|
| DE | 3213929 | A1 | 10/1983 |
| GB | 943974 | | 12/1963 |
| WO | WO00/19052 | A1 | 4/2000 |
| WO | WO2005/118457 | A1 | 12/2005 |

OTHER PUBLICATIONS

"Guardmaster Lifeline 4 Brochure Data Sheet" <http://docs-europe.electrocomponents.com/webdocs/05d7/0900766b805d708f.pdf>.*

(Continued)

*Primary Examiner* — Katherine W Mitchell
*Assistant Examiner* — Johnnie A Shablack
(74) *Attorney, Agent, or Firm* — Foley & Lardner LLP

(57) ABSTRACT

A safety device for an aerial lift (10) having a basket (20) with controls (23) which permit an operator to manoeuvre the basket (20), and a foot operable safety switch (24) which activates the controls (23), the safety device comprising an auxiliary safety switch (24) operated by a trip cord (27) arranged proximate to the controls (23) and which is connected in series with the foot safety switch (24) so that in the event that the cord is distorted the auxiliary switch (26) prevents activation of the control panel (23) and may additionally operate an alarm.

12 Claims, 3 Drawing Sheets

FIG 2

U.S. PATENT DOCUMENTS

| | | | | |
|---|---|---|---|---|
| 6,595,330 | B1 * | 7/2003 | Henrickson et al. | 187/277 |
| 6,802,391 | B2 * | 10/2004 | Ganiere | 182/69.6 |
| 7,055,912 | B2 * | 6/2006 | Luscombe | 298/22 R |
| 7,370,725 | B1 * | 5/2008 | Dornfeld | 182/2.2 |
| 7,513,334 | B2 * | 4/2009 | Calver | 182/133 |
| 2003/0173151 | A1 * | 9/2003 | Bodtke et al. | 182/18 |
| 2007/0080021 | A1 * | 4/2007 | Collins | 182/18 |
| 2010/0133043 | A1 * | 6/2010 | Black et al. | 182/148 |
| 2011/0042164 | A1 * | 2/2011 | Clark et al. | 182/2.2 |

OTHER PUBLICATIONS

"Guardmaster Lifeline 4" <http://www.farnell.com/datasheets/99861.pdf>.*

United Kingdom Search Report for GB0803611.3, issued Mar. 19, 2008, 2 pages.

European Search Report for EP 09 25 0486, issued May 28, 2009, 2 pages.

* cited by examiner

AERIAL LIFT WITH SAFETY DEVICE

FIELD OF THE INVENTION

This invention relates to an aerial lift with a safety device and in particular to an aerial lift having a cage or basket mounted on the end of an extendable boom.

BACKGROUND OF THE INVENTION

Building construction sites for large buildings frequently employ aerial lift equipment for lifting operatives to elevated locations for, for example, the installation of overhead pipework during the construction of a building.

A typical aerial lift may comprise a mobile self drive lift having an extendable boom which has an elevator basket or cage for housing operatives secured to the end of the boom. The basket may contain a control panel which permits a user standing the basket or cage to manoeuvre the cage to a raised location which facilitates the carrying out of work. The boom is typically raised by a powered hydraulic system on the vehicle.

The controls in elevator baskets typically include foot operable safety switch which needs to be closed before controls on the operator panel may be operated. If the safety device is released the movement of the basket ceases immediately. However, it has been known for some operators to cut out safety procedures by jamming the switch into a closed position by the use of a foreign body such a piece of wood. In such a situation if the operator standing at the controls is disabled by accident when the basket is in a raised condition, if the operator is caused to releases release the movement control lever, the movement of the basket ceases gradually. If the operator had become accidentally trapped between the basket and some other object, this extra movement may give rise to serious injury or may even be fatal to the operator. In some circumstance, operators have not always been hit the emergency stop provided on the control panel. A similar situation may arise when the operator is disabled but their foot remains trapped on the safety switch.

In the event that the operator is being asphyxiated and is working on their own, their predicament may not be known to others in the vicinity, then the operator may not be freed within the critical time period which is up to four minutes of the operator being unable to breathe.

The present invention provide a safety device which will help prevent death or serious injury in the event of the foot safety switch remaining closed when an operator is disabled and will warn others in the vicinity that a serious incident has occurred.

STATEMENT OF THE INVENTION

According to a first aspect of the present invention there is provided a safety device for an aerial lift having a basket or cage with a controls, typically a control panel, which permits an operator standing in the basket to manoeuvre the basket to a desired location, a foot operable safety switch which provides a switch-closed signal to a further control means before said controls on the operator panel become operable, the safety device comprising a tensioned wire or cord arranged proximate to said controls and an auxiliary safety switch connected in series with the foot safety switch, the auxiliary switch having a first set of contacts in use held in a closed condition (Switch on) by said tensioned cord or wire, and in the event that the cord is distorted the contacts are changed to a open condition (switch off) thereby cutting off the switch closed signal.

The auxiliary switch can be located in the power feed to the footswitch or in the electrical signal line between the footswitch and the control means. Preferably, the auxiliary switch is located in the power feed to the foot safety switch downstream thereof.

The auxiliary switch may include a second set of contacts that operate an alarm. The alarm may comprise a beacon and/or an audible warning device. The alarm may further include an RF transmitter which sends a radio signal to at least one further alarm remote from the basket and which includes a co-operating receiver which operates said alarms.

The auxiliary switch may include a signal filter device which inhibits a change in signal from the first and/or second set of contacts until a desired time period has elapse so as to prevent the switch off of power to the foot safety switch due to inadvertent loads acting on the tensioned cord.

The cord may be routed adjacent the control panel as is desired so as to tripped by a disabled operator during for example a collapse.

The auxiliary safety switch and the alarm are connected to the safety foot switch through readily connectable and disconnectable pin and socket connectors facilitating the assembly and dis-assembly of the safety device from the basket for testing, maintenance or re-placement.

A second aspect of the present invention provided for an aerial lift having a basket or cage having a controls which permits an operator standing in the basket to manoeuvre the basket to a desired location, a foot operable safety switch which needs to be closed before said controls become operable, and a safety device according to the first aspect of the invention.

An alarm may be mounted to the underside of the basket.

The basket may be mounted at one end of an extendable boom, which is typically raised by a powered hydraulic system on the vehicle.

DESCRIPTION OF THE DRAWINGS

The invention will be described by way of example and with reference to the accompanying drawings in which:—

DETAILED DESCRIPTION OF THE INVENTION

Figure 1:
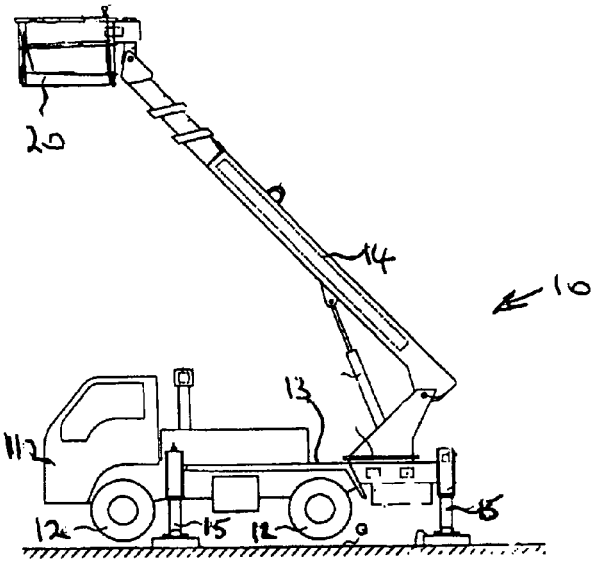
FIG. 1 is a view of a fork vehicle having aerial lift according to the present invention mounted on an extendible boom.

With reference to FIG. 1 of the drawings, there is shown a vehicle 10 in the form of a self drive mobile lift of any suitable type. The vehicle 10 has a drivable vehicle body 11 having wheels 12 and an extendable boom 14 mounted on a load carrying platform 13 at the rear of the vehicle. Stabilisers 15 are provided for steadying the vehicle on the ground G. A basket or cage 20 is mounted on the free end of the boom 14 and the basket, in use, can be raised or lowered and generally manoeuvred relative to the ground as is well known. The basket 20 is shown in a raised condition. The boom 14 is raised, lowered, extended, rotated etc. by any suitable means, typically operated by a powered hydraulic system provided on the vehicle.

The aerial lift 10 is shown by example only and any type of aerial lift may be used and the present invention is applicable to any form of aerial lift having a operator carrying basket, cage or platform which is provided with controls in the basket that allow the operator to manoeuvre the basket utilising the vehicle's power systems.

Figure 2:
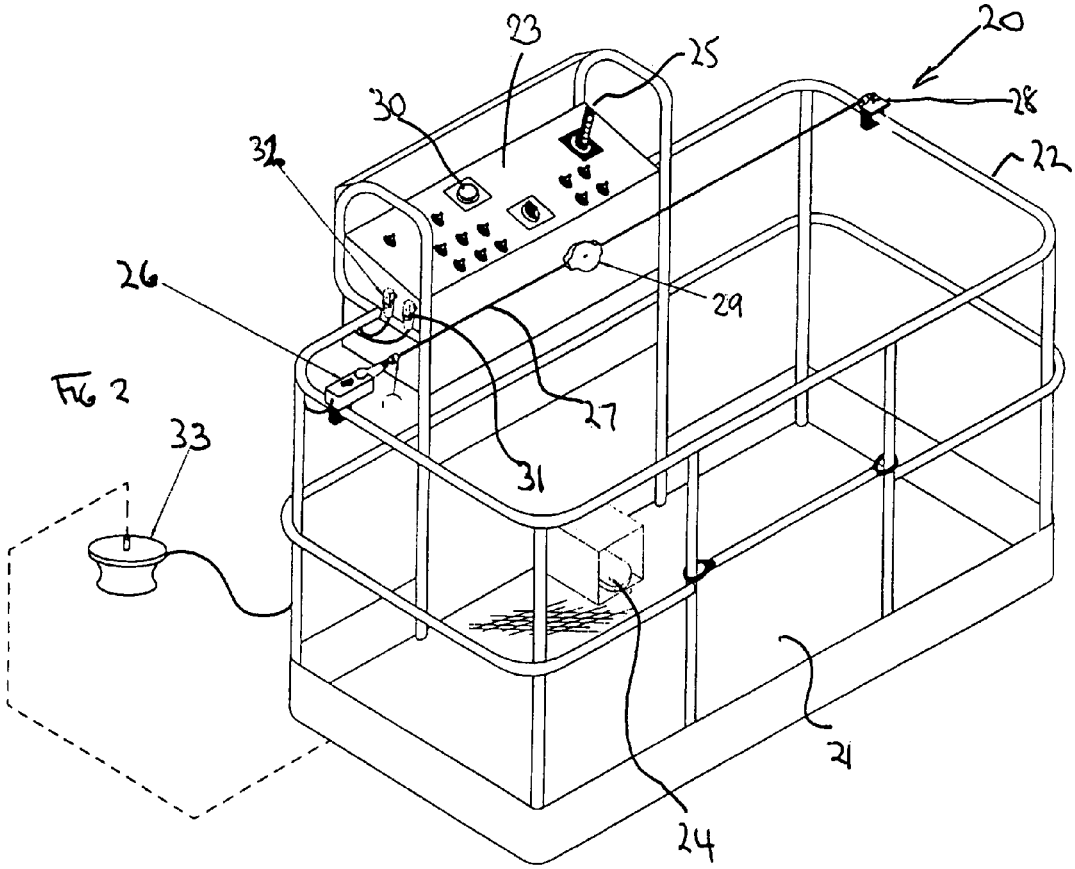
FIG. 2 is an isometric view a basket or cage mounted on the extendible boom shown in FIG. 1 having an auxiliary safety switch and trip wire.

With reference to FIG. 2, there is shown the lift or elevator basket 20 having a floor 21 surrounded by a safety barrier 22. The basket 20 is provided with controls 23 whereby an operator standing in the basket 20 can cause the basket to be moved to a desired location. The controls 23, shown as a control panel, further include a foot operated safety switch 24 which must be depressed before an operator in the basket can cause the lift 10 to move the basket. In the event that the foot safety switch 24 is raised any movement of the basket will cease immediately. The foot switch 24 is typically connected to a control means V (see FIG. 3), usually a valve, which shuts off the vehicle's power supply to prevent movement of the basket in the absence of a switch-closed signal from the foot switch. An emergency stop 30 may also be provided on the control panel. The general movement of the basket is controlled by a control lever 25.

An auxiliary safety device comprising a switch 26, trip cord 27 and alarm 33 is also provided on the basket 20. The auxiliary switch 26 is mounted on the safety barrier 22 to one side of the control 23. The switch 26 is connected via connector 31 and circuitry within the control 23 to the foot switch 24 and is operable to cut-off the power supply to the foot switch 24 which has the same effect as the foot safety switch 24 being raised. A suitable switch is a Guardmaster lifeline 4 available from Allen & Bradley. The switch 26 includes a first set on contacts C1 (see FIG. 3) which are closed when under a tension load.

The tension load is applied by the tensioned trip wire or cord 27 which extends across the front of the control 23 and is fixed to a support 28 mounted on the safety barrier 22 on the far side of the control 23. The cord 27 may be held in tension by an adjustable tensioner 29. The trip cord 27 must be positioned so to allow normal operation of the control 23 but be tripped by an operator in the event that the operation is disabled and falls or collapses within the basket. In this example the wire runs across the front of the control from which it is spaced by a suitable distance.

The auxiliary switch 26 also include a second contact set C2 (see FIG. 3) which are connected via connector 32 to an emergency alarm 33 which is mounted on the basket 20 in a visible location, preferably on the underside of the floor 21. The alarm 33 may include an RF transmitter which send a radio signal to at least one further alarm (not shown) remote from the basket 20 and which includes a co-operating receiver which operates the second alarm.

Figure 3:
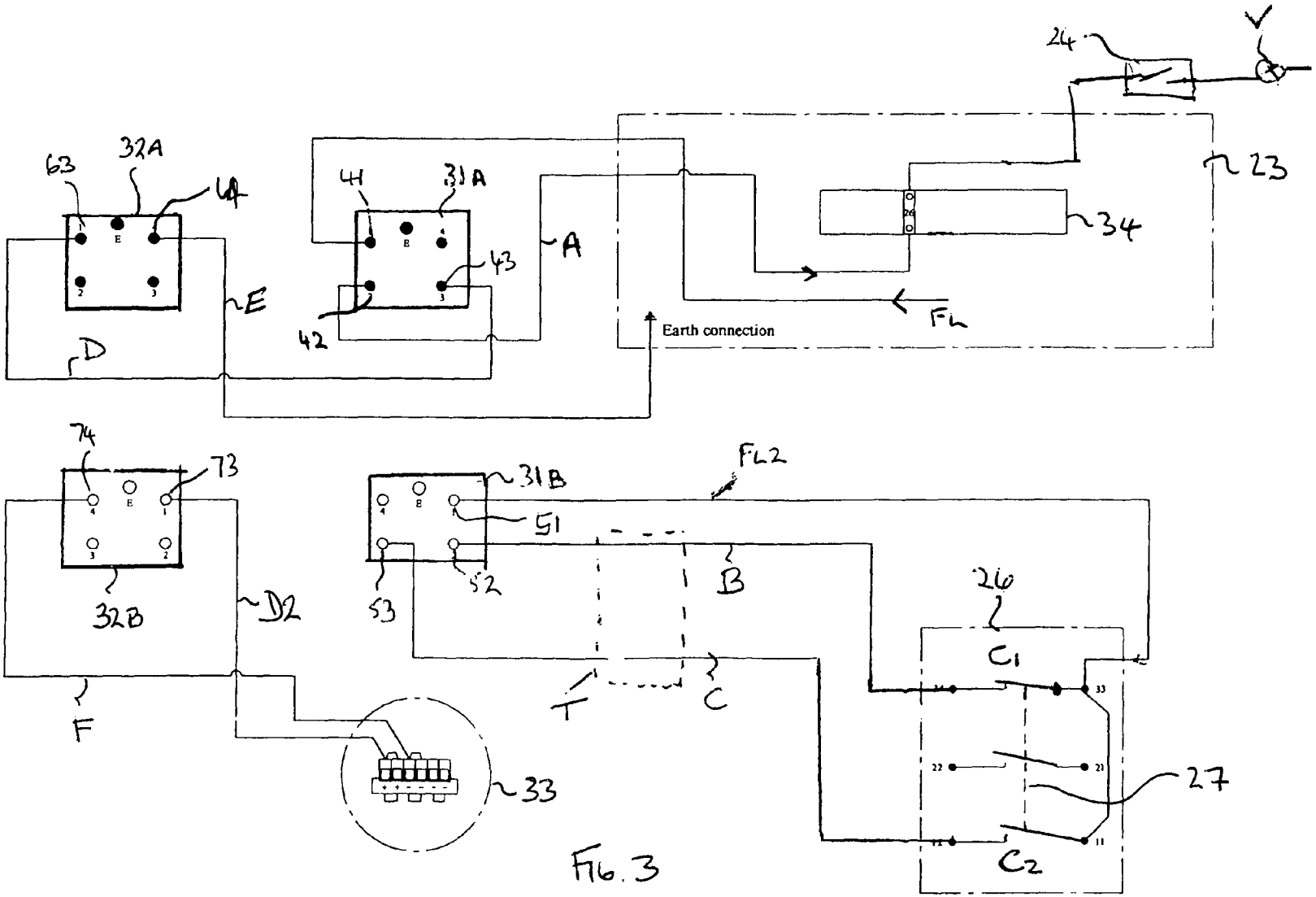
FIG. 3 is a wiring diagram for incorporation of the safety switch into the circuit of the control panel in the basket and shown with auxiliary switch held with the trip wire under tension.

Referring also to FIG. 3, there is shown the electrical circuit for the safety device. The power feed line FL to the foot safety switch 24 is diverted to a socket 41 within the socket part 31A of connector 31. A cooperating pin 51 of the plug part 31B of connector 31 is connected via electrical cable FL2 to contacts C1 and C2 in parallel. The other sides of contacts C1 and C2 are connected via electrical cable B and C to separate pins 52,53, respectively on the plug part 31B. The pins 52,53 are connectable with cooperating sockets 42 and 43 on the socket part 31A. The socket 42 is connected via electrical wire A and connection block 34 to the foot switch 24. The other socket 43 is connected by electrical cable D to a socket 63 of the socket part 32A of connector 32. A second socket 64 of the socket part 32A is connected to Earth or ground. The socket 63 is connectable with a co-operating pin 73 on the plug part 32B of connector 32. The pin 73 is connected by cable D2 to the alarm 33. The alarm 33 is grounded via cable F connected to pin 74 on the plug part 32B. The pin 74 co-operates with socket 64 for grounding the alarm 33.

As shown in FIG. 3, the trip cord 27 (represented by dotted lines) is under tension and the auxiliary switch is set with contacts C1 closed and contacts C2 open. In 15 this condition, the power feed line FL is connected through connector 31 and contacts C1 to the safety foot switch 24. The contact C2 is open cutting off power to the alarm 33.

Figure 4:
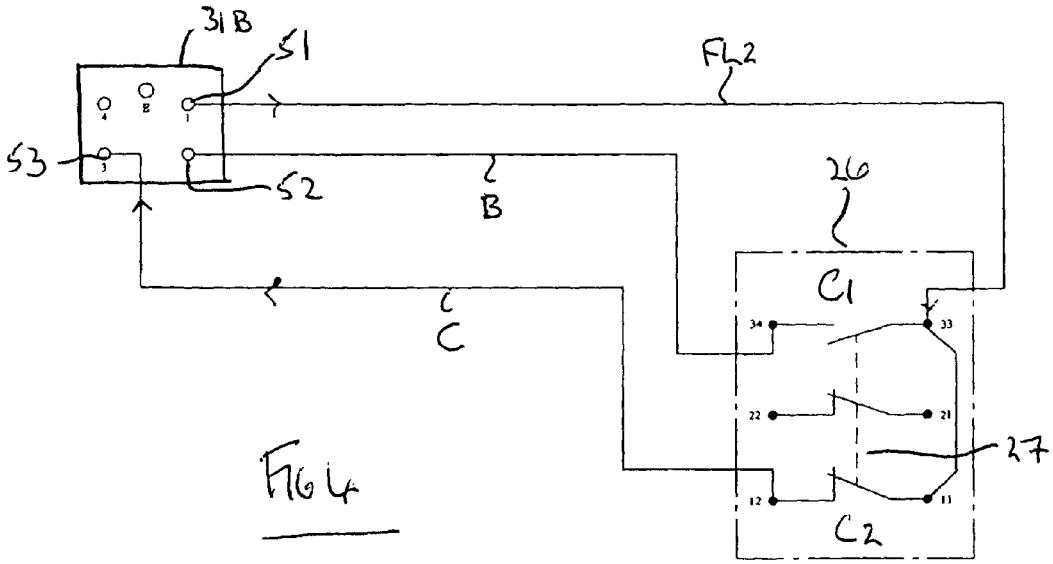
FIG. 4 is a portion of the wiring diagram shown in FIG. 3 showing the auxiliary switch having been activated.

With reference to FIG. 4, when the trip wire 27 is activated, the contacts C1 and C2 within the auxiliary switch 26 are caused to move so that C1 becomes open and C2 closes. In this state, the power feed line FL2 is disconnected from the pin 52 of the connector 31 and the power feed line FL2 is connected to the pin 53 of the connector 31. In this state power is supplied to the alarm 33 and disconnected from the foot switch 24 thus immediately immobilising the movement of the basket 20.

The circuitry in FIG. 3 could alternatively be adapted for insertion into the signal line from the switch 24 to the control means V.

Figure 5:
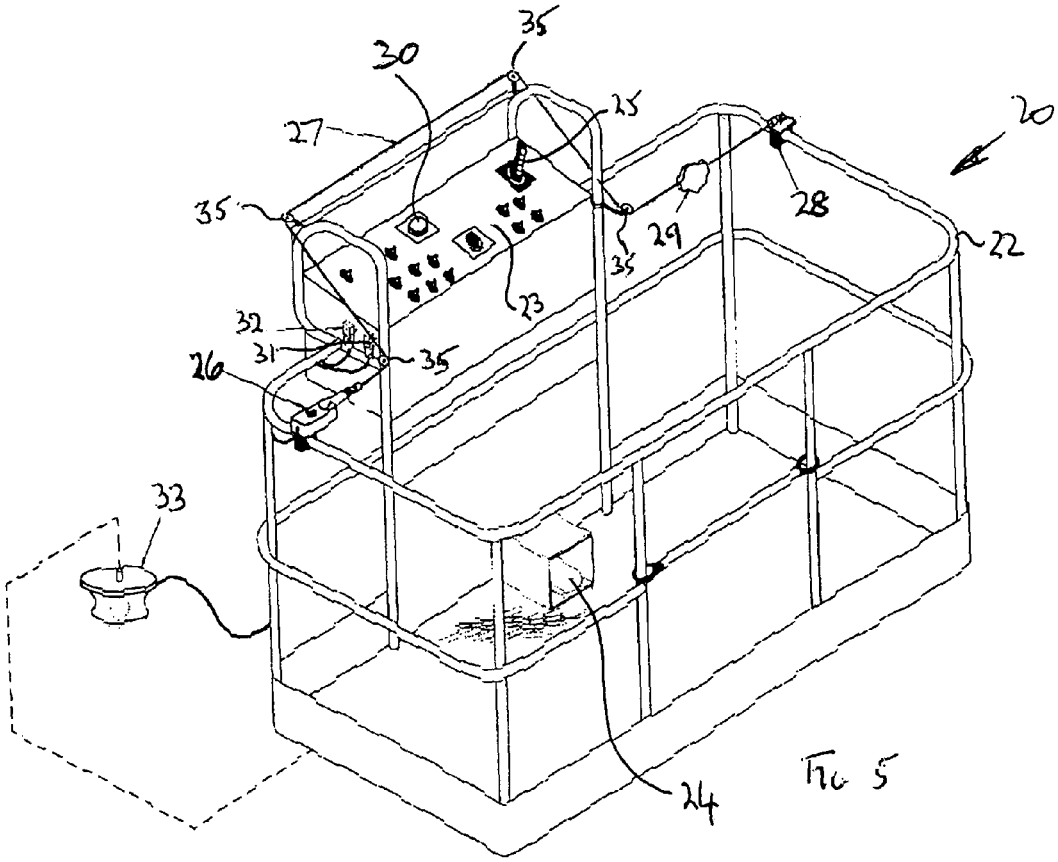
FIG. 5 is an isometric view a basket of FIG. 2 with an alternatively routed trip wire.

With reference to FIG. 5, there is shown a basket 20 in which the trip cord 27 is routed across the rear of the control panel 23. The routing of the trip cord is facilitated by the use of freely rotating pulley wheels 35 which accommodate changes in direction of the cord.

The auxiliary switch 26 may include a signal filter device T (shown in chain dotted outline) downstream of C1 and C2 which inhibits a change in signal, i.e. power signal, from the first and/or second set of contacts until a desired time period has elapse so as to reduce or prevent triggering of the safety switch due to inadvertent loads acting on the tensioned cord.

What is claimed is:

1. A safety device for an aerial lift having a basket or cage with controls which permits an operator standing in the basket or cage to manoeuvre the basket or cage to a desired location, a foot operable safety switch which provides a switch-closed signal when actuated, that permits the flow of power so as to permit the operator to manoeuvre the basket or cage via the controls, the safety device comprising a tensioned wire or cord within an operator work space defined by the basket or cage and arranged proximate to said controls, and an auxiliary safety switch connected in series with the foot operable safety switch, the auxiliary switch having a first set of contacts held in a closed, switch-on, condition by said tensioned wire or cord, and in the event that the tensioned wire or cord is distorted, the first set of contacts are changed to an open, switch-off, condition, whereby, in the event that the tensioned wire or cord is distorted while the foot operable safety switch is actuated, the auxiliary safety switch cuts off the flow of power permitted by the switch-closed signal provided by the foot operable safety switch, thereby preventing movement of the basket or cage even if the foot operable safety switch remains actuated.

2. A safety device as claimed in claim 1, wherein the auxiliary switch includes a signal filter which inhibits the changes in signal from at least one of the first and second set of contacts until a desired time period has elapse so as to prevent the switch off of power due to inadvertent loads acting on the tensioned wire or cord.

3. An aerial lift comprising a basket or cage having controls which permits an operator standing in the basket or cage to manoeuvre the basket or cage to a desired location, a foot operable safety switch which needs to be closed before said controls become operable, and a safety device as claimed in claim 1.

4. An aerial lift as claimed in claim 3, wherein the basket or cage is mounted at one end of an extendable boom.

5. A safety device as claimed in claim 1 wherein the foot operable safety switch has a main power feed line and the auxiliary switch is located in the power feed line to the foot operable safety switch downstream thereof.

6. A safety device as claimed in claim 5, wherein the auxiliary switch includes a second set of contacts that operate an alarm.

7. A safety device as claimed in claim 6, and further including readily connectable and disconnectable pin and socket connectors whereby the auxiliary safety switch and the alarm are connectable to the foot operable safety switch facilitating the assembly and dis-assembly of the safety device from the basket or cage.

8. A safety device as claimed in claim 6, wherein the alarm comprises at least one of a flashing beacon and an audible warning device.

9. A safety device as claimed in claim 8, wherein the alarm further includes a radio frequency transmitter which send a radio signal to at least one further alarm remote from the basket or cage and which includes a co-operating receiver which operates said remote alarms.

10. An aerial lift comprising a basket or cage having a controls which permits an operator standing in the basket or cage to manoeuvre the basket or cage to a desired location, a foot operable safety switch which needs to be closed before said controls become operable, and a safety device as claimed in claim 6.

11. An aerial lift as claimed in claim 10, wherein the alarm is mounted to the underside of the basket or cage.

12. An aerial lift as claimed in claim 10, wherein the basket or cage is mounted at one end of an extendable boom.

* * * * *

UNITED STATES PATENT AND TRADEMARK OFFICE

CERTIFICATE OF CORRECTION

PATENT NO. : 8,490,746 B2
APPLICATION NO. : 12/380355
DATED : July 23, 2013
INVENTOR(S) : Cummings It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 440 days.

Signed and Sealed this
Thirtieth Day of December, 2014

Michelle K. Lee

Michelle K. Lee
*Deputy Director of the United States Patent and Trademark Office*